US005374914A

United States Patent [19]

Prueitt

[11] Patent Number: 5,374,914

[45] Date of Patent: Dec. 20, 1994

[54] COMPACT MAGNETIC ENERGY STORAGE MODULE

[75] Inventor: Melvin L. Prueitt, Los Alamos, N. Mex.

[73] Assignee: The Regents of the University of California, Oakland, Calif.

[21] Appl. No.: 221,323

[22] Filed: Mar. 31, 1994

[51] Int. Cl.[5] ..... H01F 7/22

[52] U.S. Cl. ..... 335/216

[58] Field of Search ..... 335/216, 213, 214, 299, 335/301; 336/84 C, 84 M, 128, 174, 195, DIG. 1; 323/360; 505/869, 870, 879, 880

[56] References Cited

U.S. PATENT DOCUMENTS

| | | | |
|---|---|---|---|
| 3,800,256 | 3/1974 | Garwin | 307/149 |
| 4,595,843 | 6/1986 | Delvecchio et al. | 307/83 |
| 4,639,610 | 1/1987 | Delvecchio et al. | 307/83 |
| 4,912,446 | 3/1990 | Singh et al. | 336/62 |
| 4,920,095 | 4/1990 | Ishigaki et al. | 505/1 |
| 4,939,444 | 7/1990 | Cacheux | 323/360 |
| 4,992,696 | 2/1991 | Prueitt et al. | 313/154 |
| 5,006,672 | 4/1991 | Prueitt et al. | 174/125.1 |

*Primary Examiner*—Leo P. Picard
*Assistant Examiner*—Raymond Barrera
*Attorney, Agent, or Firm*—Milton D. Wyrick; William A. Eklund

[57] ABSTRACT

A superconducting compact magnetic energy storage module in which a plurality of superconducting toroids, each having a toroidally wound superconducting winding inside a poloidally wound superconducting winding, are stacked so that the flow of electricity in each toroidally wound superconducting winding is in a direction opposite from the direction of electrical flow in other contiguous superconducting toroids. This allows for minimal magnetic pollution outside of the module.

8 Claims, 3 Drawing Sheets

COMPACT MAGNETIC ENERGY STORAGE MODULE

This invention was made with Government support under Contract No. W-7405-ENG-36 awarded by the U.S. Department of Energy. The Government has certain rights in the invention.

FIELD OF THE INVENTION

The present invention is generally related to the storage of energy, and, more specifically to devices for the storage of large amounts of magnetic energy.

The current interest in moving from fossil fuel powered vehicles toward electrical powered vehicles has heightened activity in the area of battery research. Energy storage devices, such as batteries, for commercial applications in electric cars, buses and trucks must satisfy many requirements in order to make electrically powered vehicles reasonable for general use. Among these requirements, are that the energy storage devices must be compact and reasonably light weight, and must have a high energy storage to weight ratio.

Lead acid batteries, for example, are capable of storing approximately 13 watt-hours (wh) per pound, and can be deep drawn only about 1000 times. For an electrically powered vehicle, the weight of the batteries necessary to provide adequate power and travel time would be great.

Other magnetic energy storage designs have problems with the stray magnetic fields which may exist at considerable distances from the storage coils. This magnetic pollution can disrupt magnetic compasses, disorient migrating species, and, at close range, can accelerate iron objects to high velocity. Additionally, the health effects of magnetic fields is of concern, and is currently under investigation.

The present invention provides a superconducting magnetic energy storage module which is compact and, more importantly, does not produce significant magnetic pollution. It accomplishes this through a novel configuration of coil windings so that the various magnetic fields emanating from the circulating currents tend to cancel each other.

It is therefore an object of the present invention to provide compact apparatus for the storage of magnetic energy.

It is another object of the present invention to provide compact magnetic energy storage which does not produce significant magnetic energy outside of the apparatus.

It is yet another object of the present invention to provide magnetic energy storage apparatus having a high energy storage density.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the invention comprises a superconducting compact magnetic energy storage module having reduced internal stresses and low magnetic pollution comprising a plurality of superconducting toroids, each of the superconducting toroids comprising a poloidally wound superconducting winding with a toroidally wound superconducting winding located axially within the poloidally wound superconducting winding. Switching means allow electrical energy to be input to or removed from the module.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides for the storage of large quantities of magnetic energy in a relatively small space, and does so without the production of significant magnetic pollution outside of the apparatus. The invention is best understood through study of the drawings.

Figure 1:
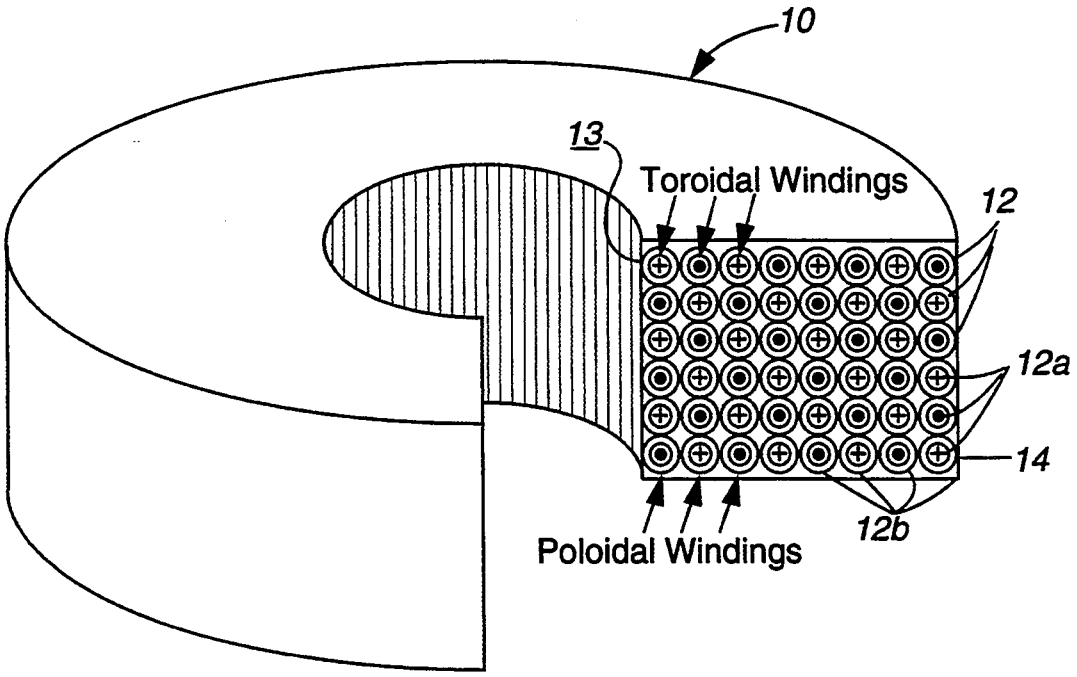
FIG. 1 is a perspective view of the present invention having a quarter section removed for clarity.

In FIG. 1, a perspective view of one embodiment of the present invention in which magnetic energy storage module 10 is shown with a quarter section removed for clarity. As seen, module 10 contains a multiplicity of superconducting toroids 12, each superconducting toroid 12 is comprised of inner toroidal windings **12*a*, and outer poloidal windings 12*b*. Each inner toroidal winding 12*a* bears alternate polarities with respect to its contiguous inner toroidal windings 12*a*. The primary reason for alternating the current flow in alternate toroidal windings 12*a*, is to eliminate magnetic field pollution outside of module 10**.

Figure 2:
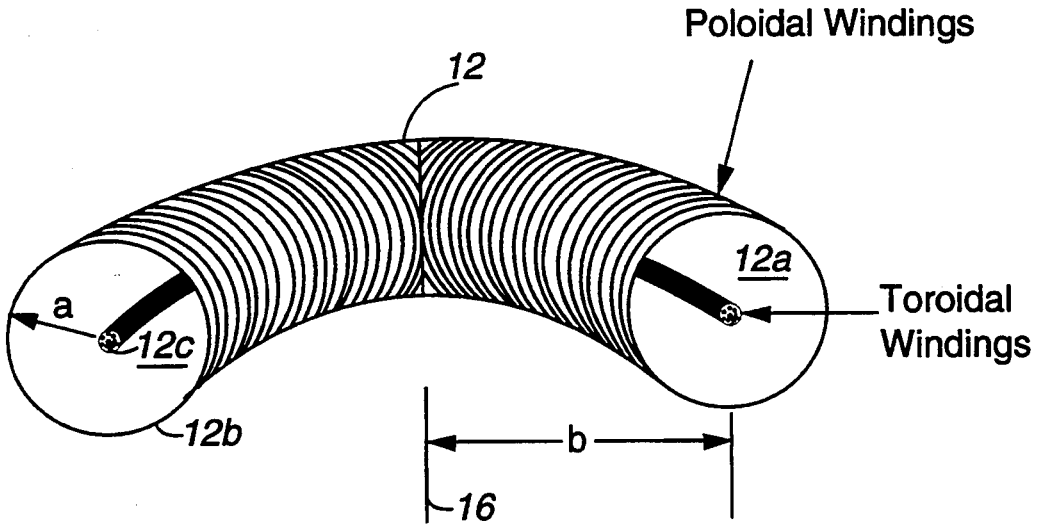
FIG. 2 is a cross-sectional view of one toroid of the present invention.

Reference should now be directed to FIG. 2, wherein there is illustrated a cross-sectional view of a superconducting toroid 12 which more clearly shows inner toroidal winding **12*a* and outer poloidal winding 12*b*. As shown, the minor radius of the toroid is labeled as "a," and the major radius is labeled as "b." The forces created by the flow of current in outer poloidal winding 12*b* tend to cause winding 12 to explode, increasing radius "a," while simultaneously tending to contract winding 12, decreasing radius "b." The forces tending to increase radius "a" can be countered by wrapping a poloidal winding of a strong material, such as KEVLAR® or other strong yarn, around winding 12. The forces tending to decrease radius "b" are countered by inner toroidal winding 12*a***, which, with current flowing, will tend to oppose those forces.

Poloidal winding **12*b* produces a magnetic field that is totally contained within superconducting toroid 12. The magnetic field due to poloidal winding 12*b* inside superconducting toroid 12 is fairly uniform, varying inversely with the distance from major axis 16 of superconducting toroid 12**.

A toroidal coil, such as inner toroidal winding 12a experiences hoop forces that tend to increase radius "b." The currents in inner toroidal winding 12a can be adjusted to exactly cancel the forces from outer poloidal winding 12b, which tend to decrease major radius "b." However, since toroidal windings 12a create forces on each other, a computer and software are used to adjust the individual currents in each toroidal winding 12a so that the outward (increasing major radius "b") forces of toroidal windings 12a cancel the inward forces of poloidal windings 12b. Individual currents in toroidal windings 12a can be varied by varying the number of turns in toroidal windings 12a. In addition to the radial forces that toroidal windings 12a exert on each other, they also exert vertical forces on each other.

Figure 3:
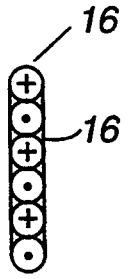
FIG. 3 is an end view of one column of superconducting toroids surrounded by a belt.

For example, in FIG. 1, bottom row 14 of superconducting toroids 12 is forced in a downward direction, while top row 13 is forced in an upward direction. As shown in FIG. 3, these forces can be easily countered by wrapping a KEVLAR® belt 15 around each column of toroids 12 in magnetic energy storage module 10 (FIG. 1). The vertical forces on all superconducting toroids 12, with the exception of toroids 12 in top row 13 and in bottom row 14, are small.

The space between inner toroidal winding 12a and outer poloidal winding 12b should be filled with a low density material such as polyethylene which conducts the force from inner toroidal winding 12a to outer poloidal winding 12b. This material maintains the shape of poloidal winding 12b, despite the asymmetry of the forces produced by outer poloidal winding 12b. Many other possibilities, such as an insulated rib structure, also exist for countering these forces.

The placement of inner toroidal winding 12a at a position near the central minor axis 12c of winding 12 causes inner toroidal winding 12a to produce very little torque on outer poloidal winding 12b, because the magnetic field produced by inner toroidal coil 12a is approximately parallel to the wires of outer poloidal winding 12b. Additionally, the magnetic field produced by outer poloidal winding 12b is approximately parallel to inner toroidal winding 12a. This is an important consideration for many superconductors since they can tolerate a stronger magnetic field along the direction of the wire without losing their superconducting properties.

In contrast, the superconducting energy storage device disclosed by Ishigaki et al., in U.S. Pat. No. 4,920,095, issued Apr. 24, 1990, uses a solenoidal coil inside a poloidal coil to attempt to counter forces tending to decrease the radius "b." However, the magnetic field produced by the solenoidal coils creates large torque on the poloidal wires. Furthermore, there are large pinch forces on the solenoidal coil that must be supported. Ishigaki et al. teach stacking their units one on top of another. Actually, this would exacerbate the pinch problem, and would produce a large amount of magnetic pollution at a distance from the device.

Computer simulations concerning the present invention indicate that a superconducting storage device for use in an electric car could have 48 superconducting toroids 12. The thickness of the KEVLAR® wrapping about superconducting toroids 12 is 0.236 inch with a safety factor of 2. A KEVLAR® belt for the module 10 (FIG. 1) is 0.02 inch thick. For this module 10, the storage capacity is 25 kwh. The finished unit would be of 40 inches diameter (without insulation), 13.4 inches high, and weigh 470 lb if all superconducting toroids 12 are filled with polyethylene. The energy storage density of this module 10 would be 50 wh/lb, compared to 13 wh/lb for a typical lead acid battery.

Although the magnetic field strength inside superconducting toroids 12 is about 25 tesla, the field strength falls off to a maximum of only approximately 0.06 tesla at a distance of 5 inches from the surface, and to approximately 0.02 tesla at a distance of 10 inches from the surface. At a distance of 10 ft, the maximum field strength is only 0.00005 tesla, or 0.5 gauss, a value comparable to the earth's magnetic field.

The energy storage density of the present invention can be improved through use of the newer high strength fibers such as extruded polyethylene which is not only much stronger than KEVLAR®, but also is significantly lighter in weight. Another construction consideration is the type of superconducting material available for superconducting toroids 12. High current densities, and the ability to function in high magnetic fields are important requirements. If room temperature superconductors are developed, the disadvantage posed by the need for refrigeration is eliminated, making the invention more attractive for automobile applications.

Smaller modules 10 could also be used in forklifts, golf carts, airport transit vehicles, and the like. Very small modules 10 could be built for use in lawn mowers and snow blowers. Larger modules 10 could find application in buses and trucks. For a bus, a module 10 would have a diameter of 80 inches, and a height of 27 inches. Its energy storage capacity would be 200 kwh.

Modules 10 may be scaled to any appropriate energy storage level, even to the size necessary to provide load leveling functions at a power plant, and still retain their modularity which allows them to be mass produced in a factory and transported to a site by flat bed trucks. As an example, a module 10 which is 15 ft in diameter and 11 ft high, exclusive of packaging and insulation, could store 5 Mwh of electric energy.

Figure 4:
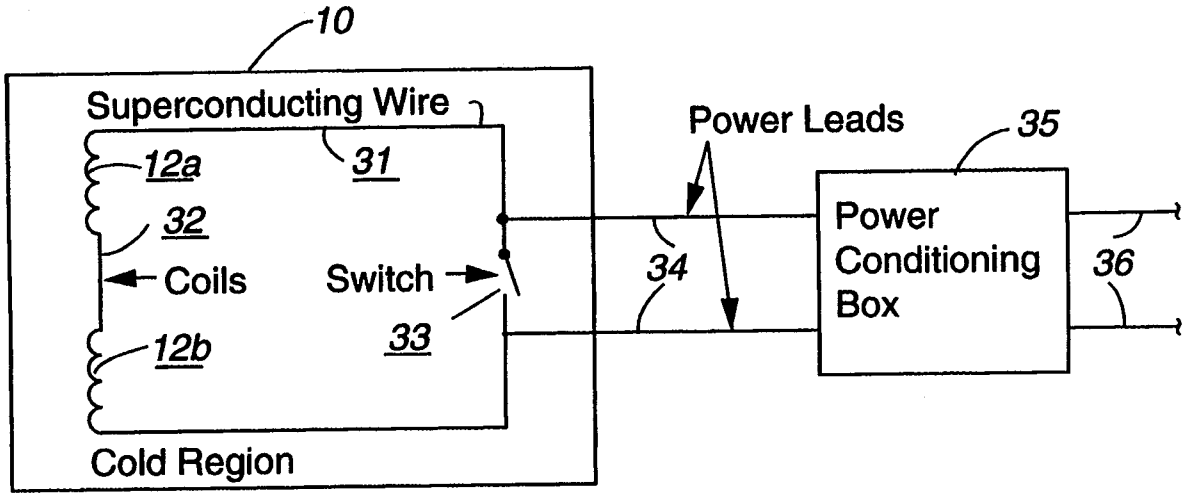
FIG. 4 is a schematic of one possible method of inputting energy into the present invention and outputting energy from the present invention.

Reference should now be directed to FIG. 4, wherein there is illustrated a schematic drawing of possible methods of inputting energy into module 10, and of extracting energy from module 10. As shown, module 10 contains superconducting wire 31 and superconducting coil 32, which represents inner toroidal windings 12a and outer poloidal windings 12b. Superconducting wire 31 terminates at switch 33, which may also be superconducting. Switch 33 can be any of a number of devices, either mechanical, electronic, or a heater at the location of switch 33 to temporarily destroy the superconducting state of superconducting wire 31.

Power leads 34 are connected from switch 33 to power conditioning box 35. Power conditioning box 35 contains the electronics required for performing certain functions on the energy entering or departing module 10, such as ac/dc conversion or voltage step-up or step-down. Such power conditioning boxes 35 are generally designed for a particular application, and are outside the scope of the present invention.

To charge, or otherwise input energy into module 10, switch 33 is opened, and voltage is applied to power leads 34. The current then flows through superconducting wire 31 and through superconducting coil 32. As current flows through superconducting coil 32, a magnetic field is established, storing energy. Thereafter, switch 33 is closed, and the stored energy continues to flow through superconducting coil 32, retaining the stored energy.

To withdraw stored energy from module 10, switch 33 is again opened with a load (not shown) attached to power leads 36. As superconducting coil 32 needs to maintain the flow of current, a voltage will develop across the load. Of course, as the magnetic field associated with superconducting coil 32 collapses to keep current flowing, the stored energy is reduced.

It is abundantly clear to those skilled in the art that until room temperature superconductors are developed, some means of cooling the present invention to temperatures sufficiently low to allow for superconductivity will be required. The means for doing this are extremely well known.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A superconducting compact magnetic energy storage module having reduced internal stresses and low magnetic pollution comprising:

a plurality of superconducting toroids, each of said superconducting toroids comprising:

a poloidally wound superconducting winding; and a toroidally wound superconducting winding located axially within said poloidally wound superconducting winding;

wherein electrical currents in contiguous toroidally wound superconducting windings flow in alternate directions.

2. The apparatus as described in claim 1, further comprising switch means for allowing electrical energy to be input into and removed from said superconducting compact magnetic energy storage module.

3. The apparatus as described in claim 1, wherein each of said superconducting toroids is wound poloidally with a strong yarn.

4. The apparatus as described in claim 2, wherein said switch means comprises heater means for raising the temperature of a section of wire from one of said superconducting toroids to temporarily destroy said superconductivity of said section of wire and allowing electrical energy to be input or withdrawn from said superconducting toroids.

5. The apparatus as described in claim 2, wherein said switch means comprises mechanical switch means for opening and closing a superconducting circuit from said superconducting toroids and allowing electrical energy to be input or withdrawn.

6. The apparatus as described in claim 1 further comprising a low density filler placed inside said superconducting toroids between said toroidally wound superconducting winding and said poloidally wound superconducting winding.

7. The apparatus as described in claim 6 wherein said low density filler comprises polyethylene.

8. The apparatus as described in claim 6 wherein said low density filler comprises an insulating rib structure.

* * * * *